United States Patent [19]

Pajala

[11] Patent Number: 4,796,402

[45] Date of Patent: Jan. 10, 1989

[54] STEP SILENCING PARQUET FLOOR

[75] Inventor: Jari Pajala, Riihimaki, Finland

[73] Assignee: Paloheimo Oy, Riihimaki, Finland

[21] Appl. No.: 31,568

[22] Filed: Mar. 30, 1987

[30] Foreign Application Priority Data

Apr. 1, 1986 [FI] Finland ..... 861396

[51] Int. Cl.[4] ..... E04F 13/08

[52] U.S. Cl. ..... 52/390; 52/391

[58] Field of Search ..... 52/177, 391, 313, 315; 428/50, 53, 60, 58, 57, 326, 44

[56] References Cited

U.S. PATENT DOCUMENTS

| | | | |
|---|---|---|---|
| 1,991,701 | 2/1935 | Roman | 52/391 |
| 2,807,057 | 9/1957 | Mondry | 52/391 |
| 2,894,292 | 1/1959 | Gramelspacher | 428/53 X |
| 3,538,665 | 10/1970 | Gohner | 52/391 |
| 3,619,964 | 11/1971 | Passaro et al. | 52/391 X |
| 4,471,012 | 9/1984 | Maxwell | 428/58 X |
| 4,682,459 | 7/1987 | Stephenson | 52/390 |

FOREIGN PATENT DOCUMENTS

| | | | |
|---|---|---|---|
| 1817556 | 2/1970 | Fed. Rep. of Germany | 428/50 |
| 1019238 | 8/1952 | France | 52/391 |

*Primary Examiner*—David A. Scherbel
*Assistant Examiner*—Creighton Smith
*Attorney, Agent, or Firm*—Banner, Birch, McKie & Beckett

[57] ABSTRACT

A step silencing board parquet, in which the sound of steps which are perceivable from one room to another is silenced by using a surface-pressed, non-homogeneous fibre board in the supporting construction layers (2 and/or 3) provided underneath the wear surface layer (1) of the board parquet.

6 Claims, 1 Drawing Sheet

STEP SILENCING PARQUET FLOOR

The invention relates to a board parquet, which consists of a wear surface layer and of at least one parallel supporting structure layer, which layers are interconnected, preferably by gluing, and of which the sides and ends are preferably matched.

Present board parquets generally consist of three layers, a wear surface layer, an intermediate lath layer and a bottom lath or veneer layer. The laminated construction, which was developed already in the 1960's, has maintained its basic structure until today. The problems connected with the living wood have successfully been solved by the cross-glued construction. Such prior known board parquets are generally matched on all sides, and their wear surface layer has been surface-treated. A floating floor construction has been achieved with thinner construction layers, and a supporting floor construction with thicker construction layers.

The silencing of steps has been a problem with these known structures, avoiding to disturb neighbours, especially those living underneath. In order to achieve the present step silencing requirements with existing board parquet products (Finnish code of building regulations C1, Sound insulating regulations 1985, Ministry of Environment) a separate step silencing felt has to be used particularly in floating floor constructions. In practice, the step sound level of the coating used with the massive concrete floors of residential and office buildings etc. concerned should be _58 dB. When installing a floating parquet in commonly used floor constructions, the above step silencing felt has to be installed before the parquet itself.

Such tested step silencing felts are available on the market, and leading parquet manufacturers recommend certain products themselves.

The purpose of the invention is to eliminate the disadvantages of known solutions. According to the invention this is achieved by one or several of the supporting construction layers being a surface-pressed, non-homogeneous fibre board which insulates the sound of steps.

The other preferable embodiments of the invention appear from the enclosed sub-claims 2 to 6.

The construction height of the product preferably corresponds to present products, whereby present products combined with a separate step silencing felt provide a specific construction height (16–18 mm). With the product according to the invention, in which no separate step silencing felt is needed, the construction height is always less or equal to that of present products. By increasing the construction height, a step silencing board parquet would easily be produced, but in practice, a floating parquet floor cannot exceed the above construction heights.

The products according to the invention can be produced with industrial methods, which requires the use of a material susceptible of being connected with wooden materials.

As step silencing element such materials may be used, of which the adhesiveness, machinability, resistance, strength and hygroscopicity fulfill the requirements of the industrial parquet production. For instance wood fibre-based non-homogeneous board products, polyethylene-based integral plastics or other materials generating the required step silencing properties, are also appropriate step silencing element materials.

The invention is described in detail below with reference to the enclosed figures, in which FIG. 1 is a sectional view taken substantially on the line 1—1 of FIG. 3.

FIG. 3 is a fragmentary top plan view of a three layer parquet flooring board in accordance with this invention.

FIG. 4 is a fragmentary top plan view of a two layer parquet flooring board in accordance with this invention.

Figure 1:
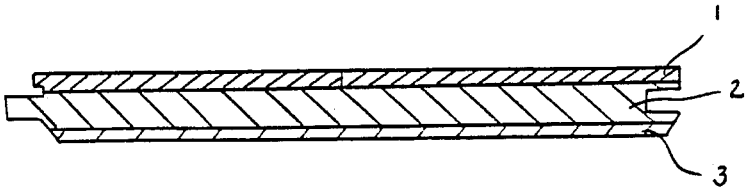

FIG. 1 shows a floor parquet, which consists of a wear surface 1, an intermediate lath layer 2 and a bottom lath layer 3. Here the intermediate lath layer 2 consists of lathes which are perpendicular to the wear surface 1. According to the invention, either the intermediate lath layer 2 or the bottom lath layer 3 may be made of a step silencing fibre board.

Figure 2:
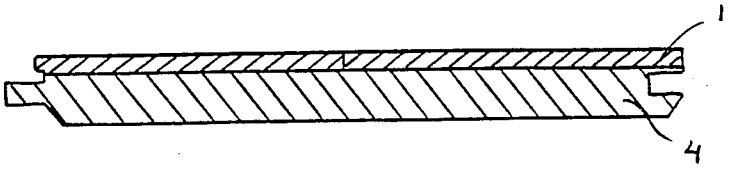
FIG. 2 is a sectional view taken substantially on the line 2—2 of FIG. 4.

FIG. 2 represents a solution, in which the bottom lath layer 4 is attached directly to the wear surface 1. The bottom lath layer 4 is then of a sound silencing material.

I claim:

1. A laminated flooring board for a parquet flooring comprising a wear resistant surface layer on top of the board and a parallel supporting construction layer bonded to the bottom side of said surface layer, said board having longitudinal sides and ends formed with a tongue and groove whereby said board will cooperate with adjacent boards to form a self-silencing parquet floor, said flooring board being characterized in that said supporting construction layer consists of a nonhomogeneous fiber board wherein said nonhomogeneity is provided by surface compactness of the fiber board.

2. A laminated flooring board according to claim 1 characterized in that said supporting construction layer has an interior which is porous.

3. A laminated flooring board according to claims 1 or 2 further characterized in that said supporting construction layer comprises an intermediate lath layer and a bottom lath layer bonded to the bottom side of said intermediate lath layer, said intermediate lath layer including fibres perpendicular to the fibres of said wear resistant surface layer and of said bottom lath layer.

4. A laminated flooring board according to claim 3, characterized in that said bottom lath layer is made of a step silencing fibre board.

5. A laminated flooring board according to claims 3 or 4 characterized in that said intermediate lath layer comprises a step silencing fibre board.

6. A laminated flooring board according to claim 1 or 2 characterized in that the supporting construction layer comprises a bottom lath layer of step silencing fibre board fixed to said wear resistant surface.

* * * * *